US012486660B2

(12) United States Patent
Mulcahy

(10) Patent No.: US 12,486,660 B2
(45) **Date of Patent: *Dec. 2, 2025**

(54) DEVICES, SYSTEMS AND METHODS FORMING VERTICAL TILT-UP WALLS AROUND WINDOW FRAMES

(71) Applicant: Monarch Materials Group, Inc., Adel, IA (US)

(72) Inventor: David S. Mulcahy, Adel, IA (US)

(73) Assignee: Monarch Materials Group, Inc., Adel, IA (US)

( * ) Notice: Subject to any disclaimer, the term of this patent is extended or adjusted under 35 U.S.C. 154(b) by 210 days.

This patent is subject to a terminal disclaimer.

(21) Appl. No.: 18/108,441

(22) Filed: Feb. 10, 2023

(65) Prior Publication Data

US 2023/0265649 A1 Aug. 24, 2023

Related U.S. Application Data

(63) Continuation-in-part of application No. 17/715,182, filed on Apr. 7, 2022, now Pat. No. 11,834,823.

(60) Provisional application No. 63/171,923, filed on Apr. 7, 2021.

(51) Int. Cl.
*E04B 1/35* (2006.01)

(52) U.S. Cl.
CPC ..... *E04B 1/355* (2013.01)

(58) Field of Classification Search
CPC . E04B 1/355; E04B 1/161; E04B 2/84; E04B 2/94; E04C 2/044; E04C 2/46
See application file for complete search history.

(56) References Cited

U.S. PATENT DOCUMENTS

| | | | | |
|---|---|---|---|---|
| 4,991,369 | A * | 2/1991 | Lamb | E06B 1/02 52/656.5 |
| 7,024,821 | B2 * | 4/2006 | Lu | E06B 3/50 49/425 |
| 7,051,988 | B2 | 5/2006 | Shaw | |
| 7,455,803 | B2 | 11/2008 | Sanger | |
| 7,828,263 | B2 | 11/2010 | Bennett | |
| 8,631,628 | B1 | 1/2014 | Beicker | |
| 8,677,696 | B2 | 3/2014 | Ryan | |
| 8,713,876 | B2 | 5/2014 | Kralic | |
| 10,947,746 | B2 | 3/2021 | White | |
| 2002/0145093 | A1 | 10/2002 | Shaw | |
| 2007/0145640 | A1 | 6/2007 | Jones | |
| 2009/0266014 | A1 * | 10/2009 | Green | E06B 1/62 52/204.55 |

(Continued)

OTHER PUBLICATIONS

Monarch Materials Group, Inc., "3 Current Style", 2022.
NOX-Crete, "Clean Line Reveal", 2018.

*Primary Examiner* — Gisele D Ford
(74) *Attorney, Agent, or Firm* — DENTONS DAVIS BROWN PC; Matthew Warner-Blankenship

(57) ABSTRACT

The disclosed apparatus, systems and methods relate to pouring concrete around a window frame begins by spraying a flat surface with a release, followed by positioning window assemblies on the flat surface. The window assemblies include at least a frame, and also possibly a sash, glazing and removable bracing. The window assemblies are secured to the flat surface and then concrete is poured around the window assembly to form a wall. Once the concrete cures around the frame, the bracing is removed, and the wall is tilted/lifted to a vertical position.

10 Claims, 9 Drawing Sheets

(56) References Cited

U.S. PATENT DOCUMENTS

| | | | | |
|---|---|---|---|---|
| 2010/0000177 | A1 | 1/2010 | Sladojevic | |
| 2014/0130444 | A1 | 5/2014 | Beicker | |
| 2014/0208685 | A1 | 7/2014 | Sladojevic | |
| 2015/0275555 | A1 * | 10/2015 | Albrecht | E05C 3/041 49/394 |
| 2022/0009196 | A1 | 1/2022 | Klein | |

* cited by examiner

DETAIL A

DEVICES, SYSTEMS AND METHODS FORMING VERTICAL TILT-UP WALLS AROUND WINDOW FRAMES

CROSS-REFERENCE TO RELATED APPLICATION(S)

This application is a continuation in part of U.S. Ser. No. 17/715,182, filed Apr. 7, 2022, which claims the benefit of U.S. Provisional Application Ser. No. 63/171,923 filed Apr. 7, 2021, the contents of these applications are hereby incorporated by reference in their entirety.

TECHNICAL FIELD

The disclosure is directed to technology related to forming a vertical wall around a window frame. More specifically, and without limitation, this disclosure relates to systems, methods and devices for forming a vertical tilt-up or precast wall.

BACKGROUND

It is well-known in the vertical tilt-up and precast wall industry to place boxes made of metal, plastic, wood, or the like between the wall forms and then pump the forms full of concrete capturing and surrounding the box. After the concrete cures all boxes are removed, and the wall is tilted/lifted to allow for installation of a separate window or other type of panel in the concrete opening to seal the wall from the outside environment.

When used in a tilt-up or precast construction, which is poured horizontally, a third-party glazer is required to supply a lift to reach the top of the wall, measure the concrete opening, and then fabricate the aluminum frame and glass to fit the concrete opening. Once completed, the glazer, again using a lift, installs the window in the opening. A number of problems exist with the current method. First, there is little consistency in the dimensions of concrete openings which requires the glazer to custom fit the window to the opening. Also, this process is time consuming requiring additional labor and materials. This known method also creates safety issues for the glazer. Finally, the method creates unnecessary job site waste. Accordingly, there is a need in the art for methods, systems and devices that address these deficiencies.

BRIEF SUMMARY

Described herein are various embodiments relating to devices, systems and methods for forming window assemblies in tilt-up applications prior to tilting the wall into a vertical position, thus removing the necessity of glazing or otherwise placing glass in the standing wall at significant cost and risk.

A method of pouring a tilt-up or precast vertical wall while in a horizontal position includes the steps of spraying a flat surface with a release and then positioning a window assembly having at least a frame, and also optionally a sash, glazing/glass and optionally bracing on the flat surface. Once positioned, the window assembly is secured to the flat surface and concrete is poured about the window assembly to form a wall. Once the concrete cures, the bracing is removed and the wall is tilted/lifted to a vertical position.

In certain Examples, the window assembly has a first side and a second side and the bracing is removably attached to each side. The bracing includes a first member which is configured to be removably received within the frame of the window assembly, and a second member transverse to the first member that covers the window assembly. The bracing, when secured to the flat surface, acts as a locator for the window assembly.

Accordingly, one objective of the disclosed systems, devices and methods is to enable the pouring of a concrete wall around a complete window frame that takes less time and is safer.

Another objective of the disclosure is to provide a method of pouring concrete around a window frame that takes less labor and materials and reduces job site waste.

Still, another objective of the present disclosure is to provide a window assembly that has an angled extension attached to the frame that is part of the window assembly prior to pouring concrete.

In Example 1, a method of pouring a tilt-up vertical wall, comprising the steps of: positioning a window assembly on a flat horizontal surface, the window assembly having at least a frame comprising glass; pouring concrete around the window assembly to form a wall; allowing the concrete to cure; and tilting the cured wall to a vertical position.

In Example 2, the method of Example 1, further comprising spraying the flat horizontal surface with a release.

In Example 3, the method of Example 1, wherein the window assembly includes a sash and the frame made of a single mold extrusion.

In Example 4, the method of Example 1, wherein the window assembly frame comprises an attached angled flange extension.

In Example 5, the method of Example 1, wherein the window assembly is secured to the flat horizontal surface, rebar or other wall compound.

In Example 6, the method of Example 1, wherein the window assembly includes optional bracing that is configured to be removed prior to tilting the wall to a vertical position.

In Example 7, the method of Example 6, further comprising securing the bracing to the flat horizontal surface.

In Example 8, the method of Example 7, wherein the step of securing comprises applying an adhesive between the frame of the window assembly and the flat surface or fastening the frame of the window assembly to the flat surface.

In Example 9, the method of Example 6, wherein the window assembly has a first side and a second side, and the bracing is removably secured to the first and the second side.

In Example 10, the method of Example 6, wherein the bracing has a first member that removably fits within the frame of the window assembly and a second member that is transverse to the first member and covers a side of the window assembly.

In Example 11, the method of Example 1, wherein the window assembly includes a sash, glazing, and bracing.

In Example 12, a window assembly for pouring a tilt-up vertical wall, comprising: a frame, comprising a first side; a second side; glass; and a sash.

In Example 13, the window assembly of Example 12, wherein the sash and the frame are made of a single mold extrusion.

In Example 14, the window assembly of Example 12, further comprising an angled flange extension comprising a first flange section that extends from a first end to a transition point; and a second flange section that extends from the transition point to a second end.

In Example 15, the window assembly of Example 14, wherein the second flange section is angled in relation to the first flange section at about 135 degrees.

In Example 16, the window assembly of Example 14, wherein the angled flange extension is attached to the frame by a claw snap fit into a recess of the frame.

In Example 17, the window assembly of Example 14, wherein the second end of the angled flange extension has a drip edge.

In Example 18, the window assembly of Example 12, further comprising first and second bracing attached to a first side and second side.

In Example 19, a system for pouring a tilt-up vertical wall, comprising a window assembly comprising a frame and glazing or glass, wherein the window assembly further comprises a sash and is configured to be positioned on a horizontal surface.

In Example 20, the system of Example 19, further comprising an angled flange extension and removable bracing, wherein the window assembly further comprises a drip edge.

While multiple embodiments are disclosed, still other embodiments of the disclosure will become apparent to those skilled in the art from the following detailed description, which shows and describes illustrative embodiments of the disclosed apparatus, systems and methods. As will be realized, the disclosed apparatus, systems and methods are capable of modifications in various obvious aspects, all without departing from the spirit and scope of the disclosure. Accordingly, the drawings and detailed description are to be regarded as illustrative in nature and not restrictive.

DETAILED DESCRIPTION

Figure 1:
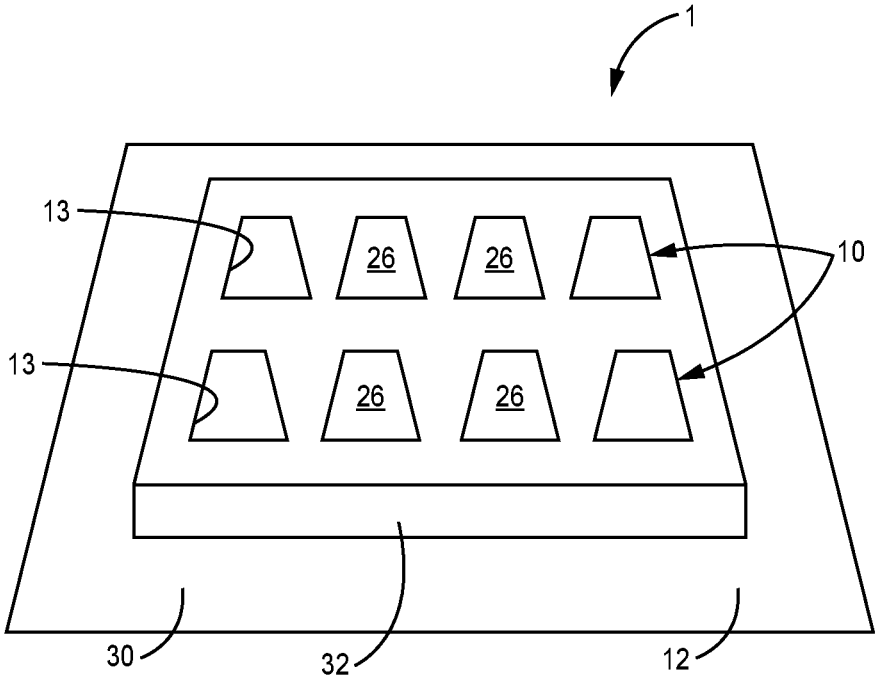
FIG. 1 is a perspective view of a plurality of window assemblies positioned on a flat surface, according to an exemplary implementation.

The various embodiments disclosed or contemplated herein relate to devices, systems and methods for the formation of window assemblies 10 in tilt-up concrete building applications, that is, the pouring of concrete walls having window assemblies on-site. Alternate implementations can be performed off-site, such as in pre-cast applications, as would be readily understood. Various implementations of the disclosed tilt-up window system 1 are described herein. Various implementations include a method for the formation of window assemblies 10 in the tilt-up walls. Further implementations include devices for the formation of window assemblies 10, such as, but not limited to, a frame 14 and angled flange extension or chamfer 34. Various further implementations will be apparent from the disclosure.

Accordingly, various implementations of the disclosed system 1 relate to the on-site formation of window assemblies 10 for the defining of window openings in a horizontal, poured tilt-up wall for tilting up into their final position so as not to require subsequent placement and glazing of windows into the vertical wall.

Turning to the drawings in greater detail, in certain implementations of the tilt-up window system 1, like those shown in FIGS. 1-8E, a method for pouring a concrete wall around a window assembly begins by positioning one or more window assemblies 10 on a flat horizontal floor or surface 12, such as an on-site poured floor.

Figure 2:
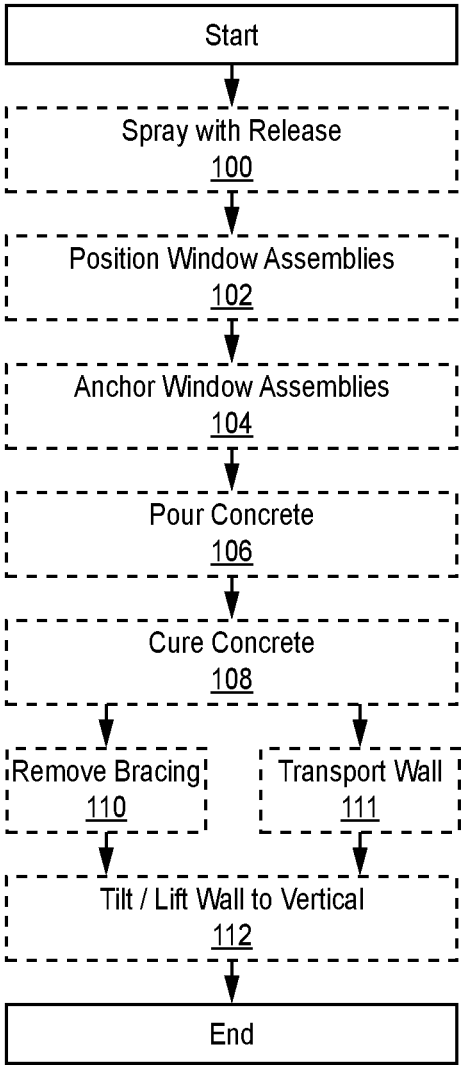
FIG. 2 is a flow diagram of a method of pouring a tilt-up vertical wall, according to an exemplary implementation.
Figure 3:
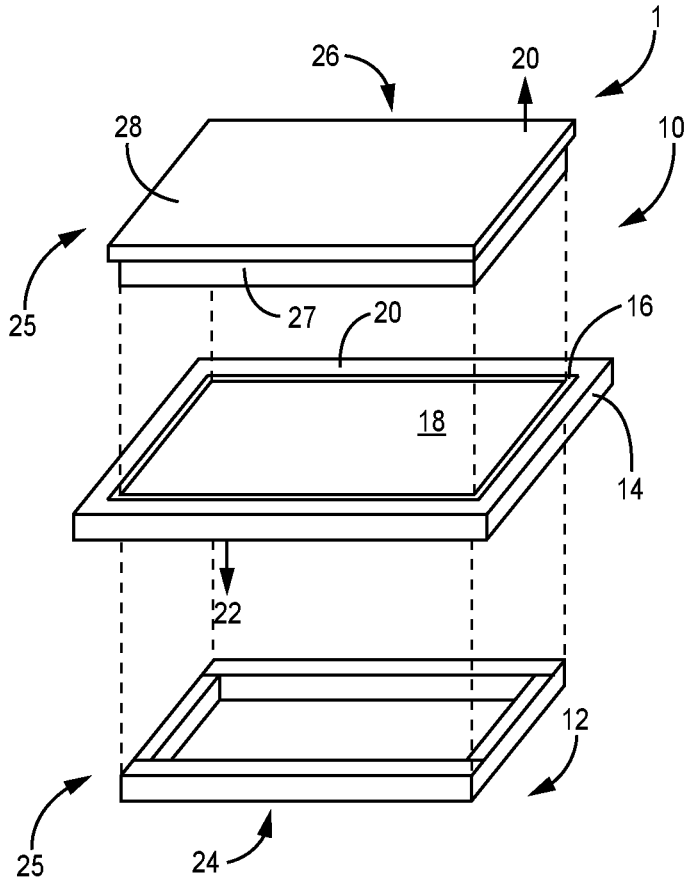
FIG. 3 is an exploded view of a window assembly, according to an exemplary implementation.

FIGS. 1-8E depict various aspects of the system 1 and method of forming the window assemblies and wall for tilt-up implementations. FIG. 1 depicts an implementation having a wall 32 formed on a floor 12, the wall 32 having a plurality of assemblies 10 disposed therein which in turn, as would be readily appreciated, define openings 13 securely containing the window assemblies 10 in the completed wall 32. FIG. 2 is a flow chart showing several optional steps for forming a wall 32 having window assemblies 10, according to certain implementations. FIG. 3 depicts an exploded view of an assembly 10 according to implementations like these. FIGS. 4A-4E show various views of a window assembly 10. FIGS. 5A-5B show cross sectional views of window assemblies 10.

Figure 6A:
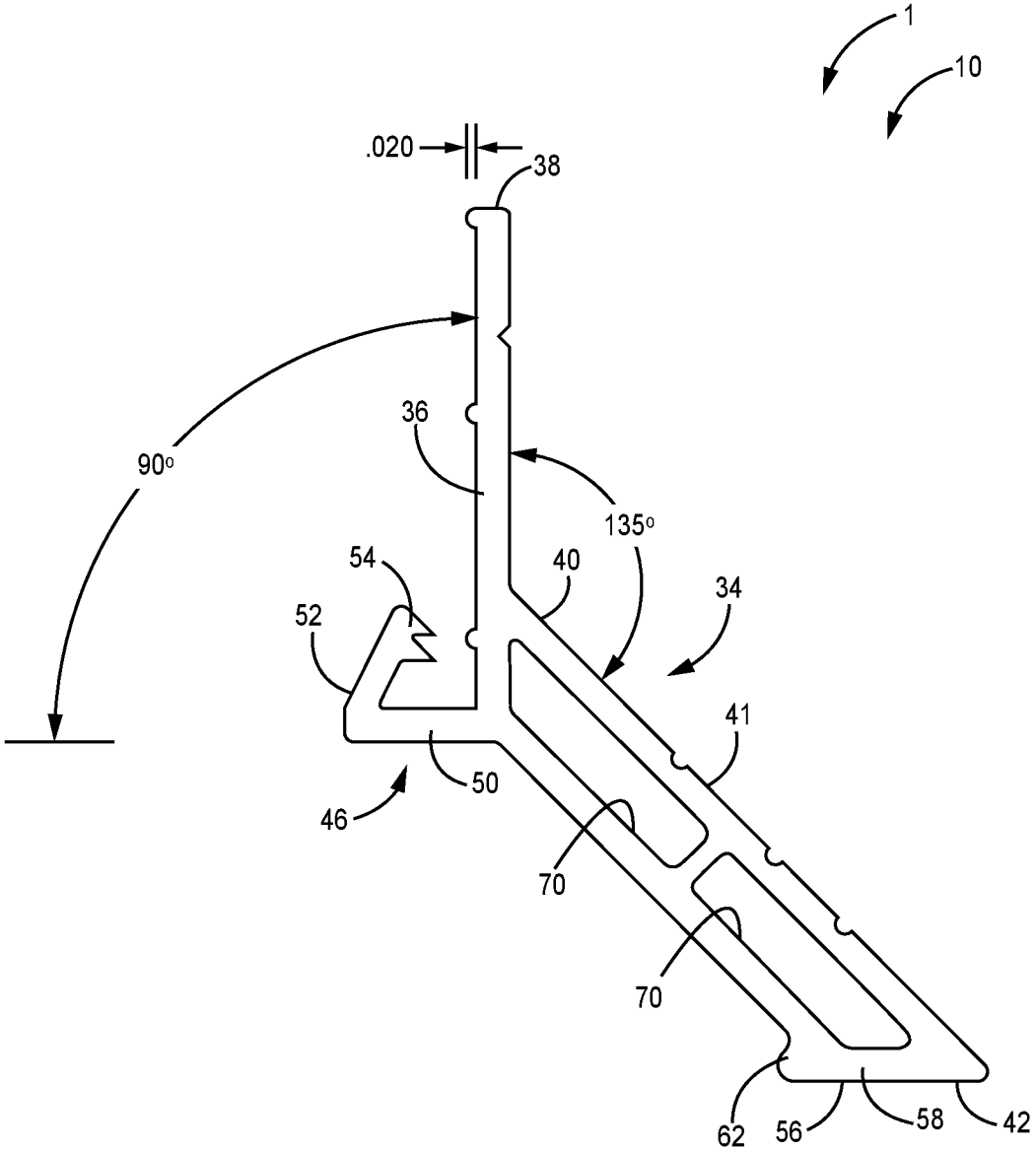
FIG. 6A is a side view of angled flange extension attached to a frame, according to an exemplary implementation.
Figure 6B:
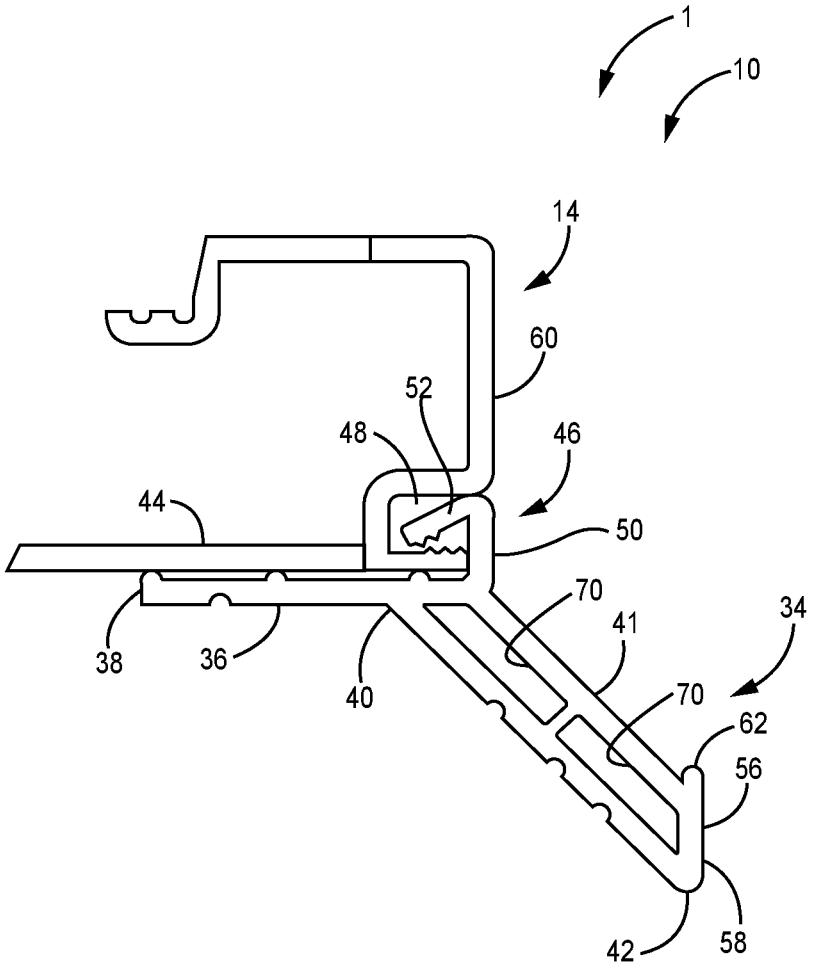
FIG. 6B is a side view of an angled flange extension, according to an exemplary implementation.
Figure 7A:
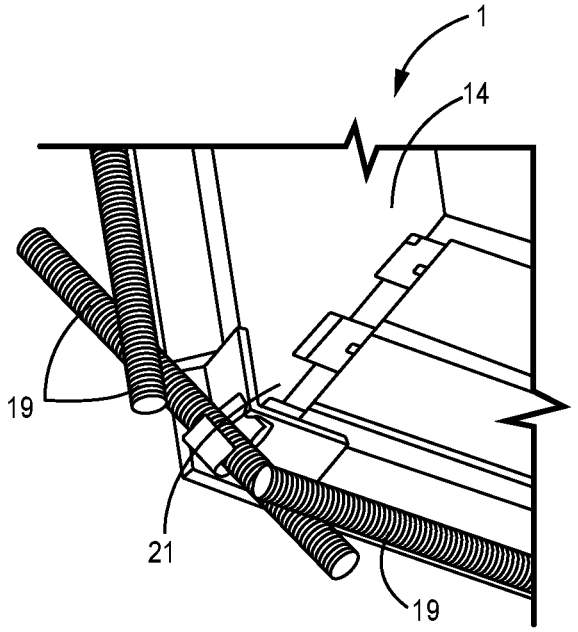
FIG. 7A is a close-up view of a window assembly and rebar attachment, according to one implementation.
Figure 7B:
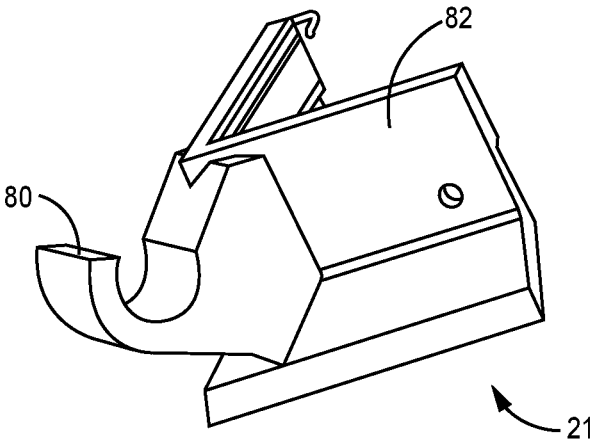
FIG. 7B is a perspective view of a rebar attachment, according to one implementation.
Figure 8C:
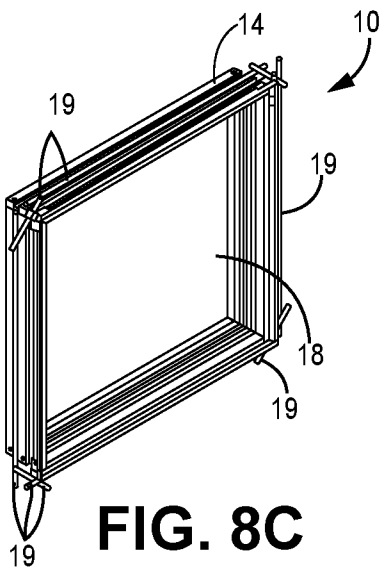
FIG. 8C is a perspective view of a window assembly attached to rebar, according to one implementation.
Figure 8B:
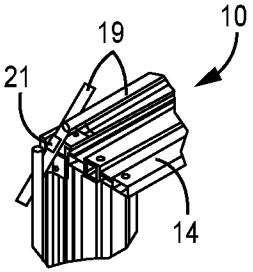
FIG. 8B is a close-up, corner view of a window assembly attached to rebar, according to one implementation.
Figure 8A:
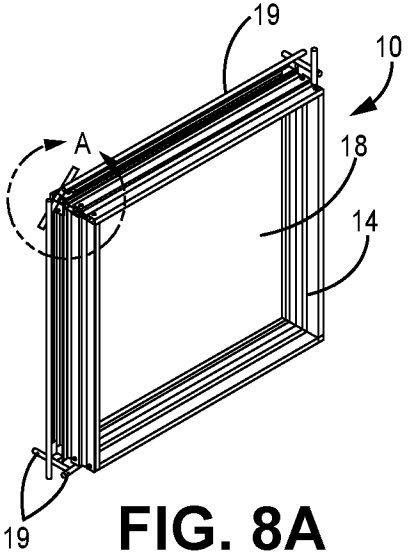
FIG. 8A is a perspective view of a window assembly attached to rebar, according to one implementation.
Figure 8E:
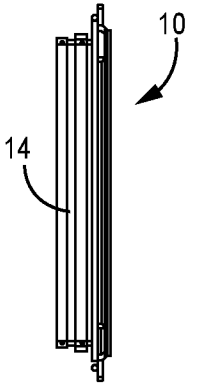
FIG. 8E is a side view of a window assembly attached to rebar, according to one implementation.
Figure 8D:
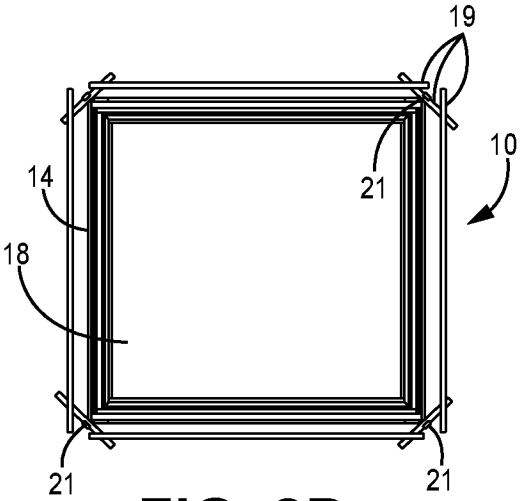
FIG. 8D is a front view of a window assembly attached to rebar, according to one implementation.

FIGS. 6A-6B depict implementations of the system 1 comprising an angled flange extension 34 or chamfer 34 is selectively attached to the frame 14 to form a part of the window assembly 10 for installation, as will be explained further herein.

In implementations like those shown in FIGS. 1 and 3, the window assemblies 10 include at least a frame 14. The window assemblies may also optionally include a sash 16, glazing or glass 18, and/or a bracing component 25, which can be a first bracing 24 and/or second bracing 26, in addition to other optional components as would be understood. It is understood that the frame 14 houses the glazing or glass 18 and certain implementations of the disclosed system 1 contemplate the placement of the window assembly 10 comprising the frame 14 and glazing or glass 18 on a horizontal surface for the pouring of a concrete wall 32 in a substantially horizontal fashion around these window assemblies 10 prior to tilting the wall up into position, which avoids having to install the glass or glazing 18 in a substantially vertical wall 32. Those of skill in the art would readily appreciate that this avoids, for example, the need for workers to climb ladders or otherwise be in the air to perform glazing after the wall has been tilted up, and therefore the system 1 increases both safety and efficiency.

Continuing with the implementations of FIGS. 1-8E, in certain of these implementations, the frame 14 and sash 16 are separate pieces attached together or alternatively are made of a single mold extrusion where the sash 16 and frame 14 are combined into one extruded profile, as would be readily understood by those of skill in the art. That is, in certain implementations a single mold extrusion process can be used to form the frame 14, optional sash 16 and other device components as would be appreciated. It is further appreciated that in certain implementations the frame 14 is of sufficient structural integrity to be configured to avoid the breaking of the glazing or glass 18 during the tilting up of the window assembly 10 and wall 32.

In various implementations, the sash 16 is an inoperable sash 16. The use of an inoperable sash 16 limits the number of moving parts, to zero, creating a more stable environment for the glass 18 in the window assembly 10. This stable environment reduces the risk of breakage during tilt up, discussed further below. As used herein the term sash 16 means any frame holding the glass 18 within the window assembly 10.

In alternative implementations, the sash 16 may be operable, allow for opening and closing of the window assembly 10.

Figure 4A:
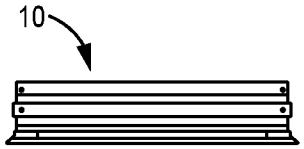
FIG. 4A is a top view of a window assembly, according to one implementation.
Figure 4B:
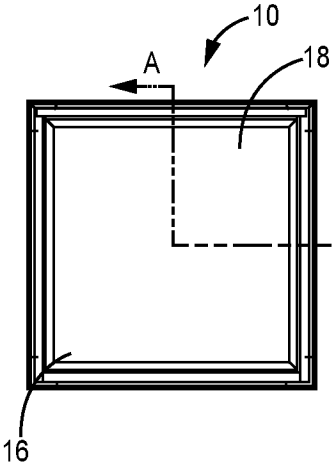
FIG. 4B is a front view of a window assembly, according to one implementation.
Figure 4C:
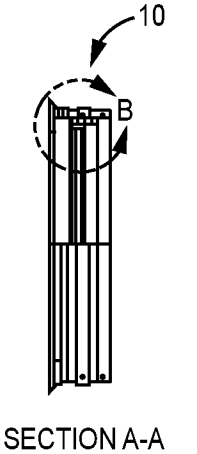
FIG. 4C is a side view of a window assembly, according to one implementation.
Figure 4D:
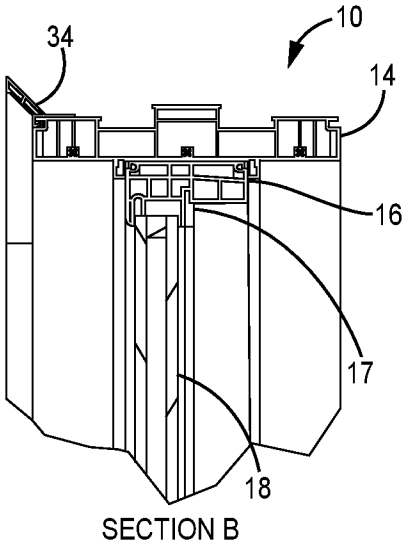
FIG. 4D is a schematic, cross-sectional view of a window assembly, according to one implementation.
Figure 4E:
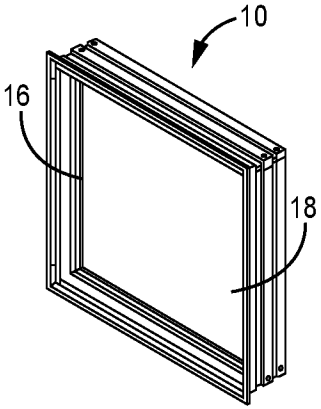
FIG. 4E is a perspective view of a window assembly, according to one implementation.
Figure 5A:
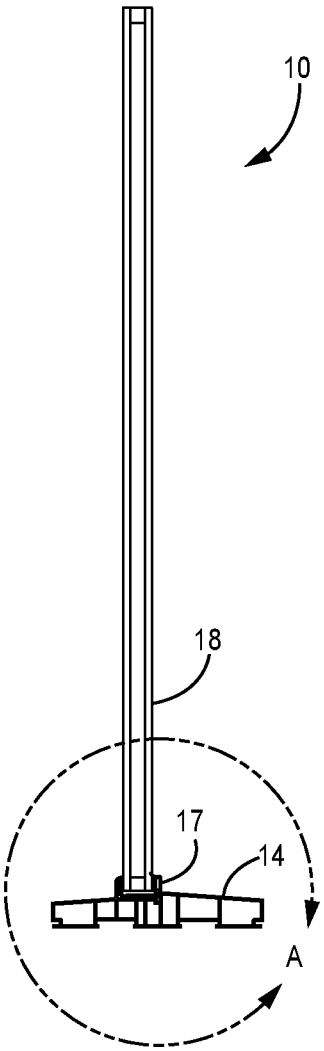
FIG. 5A is a partial cross-sectional view of a window assembly, according to one implementation.
Figure 5B:
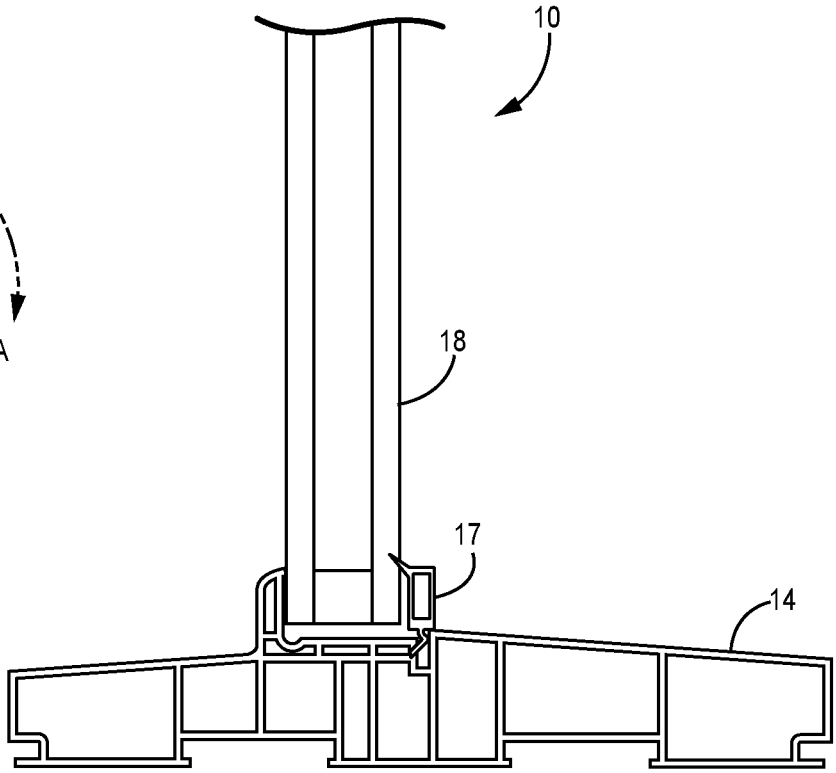
FIG. 5B is a close-up, cross-sectional view of a window assembly, according to one implementation.

In further implementations, the window assembly 10 includes a glazing bead 17, shown for example in FIGS. 4D and 5A-B. The glazing bead 17 allows for the removal of glass 18, such as for repairs or replacement, as would be understood. It would be appreciated that the inclusion of a glazing bead 17 may be advantageous in implementation where the frame 14 and sash 16 are not removable.

Continuing with the various implementations of FIGS. 1-8E, the various window assemblies 10 comprising a frame 14 can have a first side 20 and a second side 22 attached to bracing 25, that is, in certain implementations the first bracing 24 and/or second bracing 26, respectively. The bracing 25 can be of any size, shape or structure, as would be appreciated. The example shown in FIG. 3 has first bracing 24 and second bracing 26 and a first bracing member 27 and a second bracing member 28, where the second bracing member 28 is transverse or perpendicular to the first bracing member 27. In these and other implementations, the first bracing member 27 is formed and positioned to be removably received within the frame 14 of the window assembly 10, while the second bracing member 28 covers the first 20 and second side 22 of the window assemblies 10. It is understood, however, that the bracing 25 is optional, and can be omitted, and that in certain implementations only first bracing 24 or second bracing 26 is utilized and is sufficient to accomplish the formation of the window assemblies 10.

In certain implementations of the system 1, and as shown in FIGS. 6A-6B, an angled flange extension 34 or chamfer 34 is selectively attached to the frame 14 to form a part of the window assembly 10 for installation. In these implementations, the angled flange extension 34 has a first flange section 36 that extends from a first end 38 to a transition point 40, and a second flange section 41 that extends from the transition point 40 to a second end 42. The second flange section 41 extends away from the frame 14 and is at about 135 degrees in relation to the first flange section 36, alternative angles are possible and contemplated herein. Further the second flange section 41 optionally defines one or more lumens 70 therein, as would be appreciated. In any event, other angles, orientations and configurations are of course possible. In various implementations, the first flange section 36 extends along and engages a bottom member 44 of the frame 14 of the window assembly 10.

Continuing with the implementations of FIGS. 6A-6B, the angled flange extension 34 according to these implementations is attached to the frame 14 in any manner. In the example shown in FIG. 6B, the angled flange extension 34 has a claw 46 that is configured to snap fit into a recess 48 in the frame 14. Other methods of attachment of the angled flange extension 34 or chamfer 34 are of course possible.

In these and other implementations, the claw 46 has a first claw portion 50 that is perpendicular to the first flange section 36 and a second claw portion 52 that extends at an angle from the first claw portion 50 back toward the first flange section 36. At the end of the second claw portion 52 are one or more teeth 54 that are positioned to engage one or more teeth in the recess 48 of the frame 14 that is sized for the snap fit, as would be understood.

Continuing with the implementations of FIGS. 6A-6B, the second end 42 of the angled flange extension 34 in certain implementations has a drip edge 56 that directs water that flows down the face of the wall to fall off the drip edge instead of flowing back toward the window assembly 10. The drip edge 56, optionally, includes a longitudinal drip section 58 that dwells in a spaced parallel plane to the side 60 of the frame 14 and extends from the second end 42 back toward the frame 14 to a nob 62 that extends beyond a second flange section 41 of the angled flange extension 34.

Turning to FIGS. 7A-8E in more detail, in various implementations, the window assembly 10 and frame 14 may be secured to rebar 19 within the wall 32. Rebar 19 is placed within the wall 32 and about the frame 14 via any known technique, as would be understood. Optionally, a rebar attachment 21 is provided to interlock the frame 14 and the rebar 19 to secure the window assembly 10 in place. As shown in FIG. 7B, the rebar attachment 21 may include a hook 80 shaped to engage the rebar 21 and a flange 82 for attachment to the window assembly 10/frame 14. The rebar attachment 21 may be integral to the frame 14 or otherwise attached thereto by any known or appreciated mechanism, such as via adhesive or a fastener. Certain non-limiting examples of fasteners including nuts, screws, bolts, brads and the like.

In further implementations, the window assembly 10 is secured to other wall compounds.

In a further optional implementation, the window assembly 10 may include a tie slot to attach the frame 10 to the concrete form, as would be appreciated by those of skill in the art.

Returning to FIG. 2, an exemplary workflow or method of assembling the window assemblies 10 according to certain implementations. It is understood that this implementation is exemplary, and that it comprises a series of optional steps and sub-steps, which may be performed in various orders, and each of which may be omitted or substituted with other procedures, as would be readily appreciated by those of skill in the art.

In a first optional step, prior to positioning the window assemblies 10 on the floor 12 a release 30 is sprayed on the floor to permit the wall 32 to be lifted from the floor without resistance (box 100).

In another optional step, the window assemblies are positioned on the floor 12 or surface (box 102), and once positioned the window assemblies are optionally secured/ anchored (box 104) to the floor 12. It is understood that the window assemblies 10 are secured and positioned in any conventional manner for locating the bracing 25 on the floor 12, such as by using double sided tape or other adhesive that is applied between the frame 14 or bracing 24 to the floor 12, by nailing the frame 14 or bracing 25 to the floor 12, or the like, as would be readily appreciated.

In various implementations, the frame 14 may optionally be attached to rebar within the wall 32 during anchoring (box 104). In these implementations, by attaching the frame 14 to rebar the window assembly 10 is held in place while the concrete is poured (box 106) about the window assembly 10.

In another optional step, concrete is poured (box 106) about the window assemblies 10 and the concrete forms to the frame 14 so as to create the wall 32 with the window assemblies 10 defined therein.

The concrete may then be allowed to cure (box 108). After the concrete cures (box 108), if bracing is used, the bracing 25 is removed (box 110). Optionally, the wall 32 may be transported (box 11) into place at a worksite, if created offsite. In another optional step, the wall 32 is tilted/lifted upwardly (box 112) to a vertical position via a known tilt-up approach/method, as would be understood.

In certain alternate implementations, the disclosed system 1 can be utilized in pre-cast settings. That is, the window assemblies 10 are placed (box 102) and the walls are poured (box 106), and the after curing (box 108), the completed wall 32 is subsequently transported (box 111) to the final job site, placed and tilted up (box 112). It is understood that in these implementations and others, any bracing 25 used may be removed at any point between curing (box 108) and tilting (box 112) steps.

It is appreciated that in various implementations, the bracing 25 can be reused. As the frames 14 typically have consistent measurements, there is no need to fabricate other window parts to fit the frame 14, and if the window assembly 10 includes a sash 16 and glass 18 no further effort is needed to install the window assembly 10. More specifically, no lift is needed for a glazer to be lifted to the top of the wall over uneven ground making the process safer for the glazer. Also, there is no job site waste as the bracing 25 can be reused and there are no boxes that need to be disposed of. The process reduces labor and materials, and not only is more profitable, but is also safer than prior known methods.

From the above discussion and accompanying figures and claims it will be appreciated that the wall assemblies 10 for use in pouring a tilt-up or precast walls offers many advantages over the prior art.

Although the disclosure has been described with reference to preferred embodiments, persons skilled in the art will recognize that changes may be made in form and detail without departing from the spirit and scope of the disclosed apparatus, systems and methods.

What is claimed is:

1. A method of pouring a tilt-up vertical wall, comprising the steps of:

positioning a window assembly on a flat horizontal surface, the window assembly having at least a frame housing glass;

pouring concrete around the window assembly to form a wall;

allowing the concrete to cure; and tilting the cured wall to a vertical position.

2. The method of claim 1, further comprising spraying the flat horizontal surface with a release.

3. The method of claim 1, wherein the window assembly includes a sash and the frame made of a single mold extrusion.

4. The method of claim 1, wherein the window assembly frame comprises an attached angled flange extension.

5. The method of claim 1, wherein the window assembly is secured to the flat horizontal surface, rebar or other wall compound.

6. The method of claim 1, wherein the window assembly includes bracing that is configured to be removed prior to tilting the wall to a vertical position.

7. The method of claim 6, further comprising securing the bracing to the flat horizontal surface.

8. The method of claim 7, wherein the step of securing the bracing to the flat horizontal surface comprises applying an adhesive between the frame of the window assembly and the flat surface or fastening the frame of the window assembly to the flat surface.

9. The method of claim 6, wherein the window assembly has a first side and a second side, and the bracing is removably secured to the first and the second side.

10. The method of claim 6, wherein the bracing has a first member that removably fits within the frame of the window assembly and a second member that is transverse to the first member and covers a side of the window assembly.

* * * * *